US005683039A

United States Patent [19]

Leute et al.

[11] Patent Number: 5,683,039

[45] Date of Patent: Nov. 4, 1997

[54] LAVAL NOZZLE WITH CENTRAL FEED TUBE AND PARTICLE COMMINUTION PROCESSES THEREOF

[75] Inventors: Gerardo Leute, Penfield; Lewis S. Smith, Fairport; Kenneth D. Henderson, Rochester, all of N.Y.

[73] Assignee: Xerox Corporation, Stamford, Conn.

[21] Appl. No.: 623,241

[22] Filed: Mar. 28, 1996

[51] Int. Cl.[6] ..... B02C 19/06

[52] U.S. Cl. ..... 241/5; 241/39

[58] Field of Search ..... 241/5, 39, 40, 241/80, 97

[56] References Cited

U.S. PATENT DOCUMENTS

| | | | |
|---|---|---|---|
| 2,735,626 | 2/1956 | Trost | 241/39 |
| 3,688,991 | 9/1972 | Andrews | 241/39 X |
| 4,524,915 | 6/1985 | Yamagishi | 241/39 |
| 4,582,264 | 4/1986 | Stephanoff et al. | 241/97 X |
| 4,592,302 | 6/1986 | Motoyama et al. | 241/39 X |

FOREIGN PATENT DOCUMENTS

| | | | |
|---|---|---|---|
| 87/01617 | 3/1987 | WIPO | 241/39 |

OTHER PUBLICATIONS

Condur UK-6 Dewer Court; "Condux Fluidized Bed Opposed Jet Mills CGS"; *Examples of Application*;.

*Primary Examiner*—Mark Rosenbaum
*Attorney, Agent, or Firm*—John L. Haack

[57] ABSTRACT

A fluidized bed jet mill for grinding particulate material including a jetting nozzle comprising: a first hollow cylindrical body with a first diameter, wherein one end of the body is directed towards the center of the jet mill and the other end traverses the wall of the jet mill; and a hollow cylindrical curvilinear body with a diameter which is less than said first diameter, wherein the first end of the curvilinear body is collinear with the long axis of said first hollow cylindrical body, wherein the first end of the curvilinear body is at a point approximately equal to the end of the first hollow cylindrical body, wherein the second end of the curvilinear body passes through an opening in the side wall of said first hollow cylindrical body, and wherein said side wall opening is leak free and resides within the grinding chamber of the fluid bed mill; and wherein the nozzle communicates the gas stream from a high pressure source to the grinding chamber.

25 Claims, 5 Drawing Sheets

LAVAL NOZZLE WITH CENTRAL FEED TUBE AND PARTICLE COMMINUTION PROCESSES THEREOF

REFERENCE TO COPENDING AND ISSUED PATENTS

Attention is directed to commonly owned and assigned U.S. Pat. No. 5,133,504, issued Jul. 28, 1992, entitled "THROUGHPUT EFFICIENCY ENHANCEMENT OF FLUIDIZED BED JET MILL".

Attention is directed to commonly owned and assigned, copending application U.S. Ser. No. 08/409,125 (D/94639) now U.S. Pat. No. 5,562,253, filed Mar. 23, 1995, entitled "THROUGHPUT EFFICIENCY ENHANCEMENT OF FLUIDIZED BED JET MILL", wherein there is disclosed a fluidized bed jet mill for grinding particulate material comprising: a grinding chamber having a peripheral wall, a base, and a central axis; an impact target with a hollow cavity defined thereby, and with at least three apertures traversing the walls thereof, the target being mounted within the grinding chamber and centered on the central axis of the grinding chamber; and a plurality of sources of high velocity gas, the gas sources being mounted in the grinding chamber in the peripheral wall, arrayed symmetrically about the central axis, and oriented to direct high velocity gas along an axis substantially perpendicularly intersecting the central axis within the impact target, each of the sources of high velocity gas comprising a nozzle having an internal diameter; wherein the impact target has a cross section area in a plane parallel to the central axis, and the cross section area is greater than the cross section area of the internal diameter of the nozzle; and wherein the distance between the impact target and any of the nozzles is greater than the internal diameter of the nozzle; and U.S. Ser. No. 08/571,664 (D/95414) filed Dec. 13, 1995, entitled "FLUIDIZED BED JET MILL NOZZLE AND PROCESSES THEREWITH", wherein there is disclosed a fluidized bed jet mill for grinding particulate material including a jetting nozzle comprising: a hollow cylindrical body; an integral face plate member attached to the end of the cylindrical body directed towards the center of the jet mill; and an articulated annular slotted aperture in the face plate for communicating a gas stream from the nozzle to the grinding chamber to form a particulate gas stream in the jet mill.

The disclosure of the above mentioned patents and copending applications are incorporated herein by reference in their entirety.

BACKGROUND OF THE INVENTION

Fluid energy mills or jet mills are size reduction machines in which particles to be ground, known as feed particles, are accelerated in a stream of gas such as compressed air or steam, and ground in a grinding chamber by their impact against each other or against a stationary surface in the grinding chamber. Different types of fluid energy mills can be categorized by their particular mode of operation. Mills may be distinguished by the location of feed particles with respect to incoming air. In the commercially available Majac jet pulverizer, produced by Majac Inc., particles are mixed with the incoming gas before introduction into the grinding chamber. In the Majac mill, two streams of mixed particles and gas are directed against each other within the grinding chamber to cause fracture of the particles. An alternative to the Majac mill configuration is to accelerate, within the grinding chamber, particles that are introduced from another source. An example of the latter is disclosed in U.S. Pat. No. 3,565,348 to Dickerson, et al., which shows a mill with an annular grinding chamber into which numerous gas jets inject pressurized air tangentially.

During grinding, particles that have reached the desired size must be extracted while the remaining, coarser particles continue to be ground. Therefore, mills can also be distinguished by the method used to classify the particles. This classification process can be accomplished by the circulation of the gas and particle mixture in the grinding chamber. For example, in "pancake" mills, the gas is introduced around the periphery of a cylindrical grinding chamber, short in height relative to its diameter, inducing a vorticular flow within the chamber. Coarser particles tend to the periphery, where they are ground further, while finer particles migrate to the center of the chamber where they are drawn off into a collector outlet located within, or in proximity to, the grinding chamber. Classification can also be accomplished by a separate classifier. Typically, this classifier is mechanical and features a rotating, vaned, cylindrical rotor. The air flow from the grinding chamber can only force particles below a certain size through the rotor against the centrifugal forces imposed by the rotation of the rotor. The size of the particles passed varies with the speed of the rotor; the faster the speed of the rotor, the smaller the particles. These particles become the mill product. Oversized particles are returned to the grinding chamber, typically by gravity.

Yet another type of fluid energy mill is the fluidized bed jet mill in which a plurality of gas jets are mounted at the periphery of the grinding chamber and directed to a single point on the axis of the chamber. This apparatus fluidizes and circulates a bed of feed material that is continually introduced either from the top or bottom of the chamber. A grinding region is formed within the fluidized bed around the intersection of the gas jet flows; the particles impinge against each other and are fragmented within this region. A mechanical classifier is mounted at the top of the grinding chamber between the top of the fluidized bed and the entrance to the collector outlet.

The primary operating cost of jet mills is for the power used to drive the compressors that supply the pressurized gas. The efficiency with which a mill grinds a specified material to a certain size can be expressed in terms of the throughput of the mill in mass of finished material for a fixed amount of power expended and produced by the expanding gas. One mechanism proposed for enhancing grinding efficiency in particle grinding mills is the projection of particles against a plurality of fixed, planar surfaces, and fracturing the particles upon impact with the surfaces. An example of this approach is disclosed in U.S. Pat. No. 4,059,231 to Neu, in which a plurality of impact bars with rectangular cross sections are disposed in parallel rows within a duct, perpendicular to the direction of flow through the duct. The particles entrained in the air stream passing through the duct are fractured as they strike the impact bars. U.S. Pat. No. 4,089,472 to Siegel et al., discloses an impact target formed of a plurality of planar impact plates of graduated sizes connected in spaced relation with central apertures through which a particle stream can flow to reach successive plates. The impact target is interposed between two opposing fluid particle streams, such as in the grinding chamber of a Majac mill.

A fluid bed jet mill with improved grinding efficiencies and operational economics is available from CONDUX Maschinenbau GmbH & Co. (Netzsch Condux Inc., Pennsylvania), as "CONDUX Fluidized Bed Opposed Jet Mill CGS" wherein the jet mill is equipped with a centrally mounted return feed device. The feed device consists of an external pipe line which is connected at one end near the classification zone of the fluid bed chamber and the other end protrudes through to the high pressure air line at, or near, the nozzle jet inlet to the grind chamber and protrudes through the nozzle thereby allowing material to be converged from the classifying zone to the center of the jet. The external pipe line provides increased material fed to the grind zone through partial external material return through the jet nozzles.

The CONDUX CGS apparatus and grinding process thereof are disadvantaged in that: high pressure external piping is required; the return pipe line configuration may lead to over grinding of particulate materials since the inlet port of the pipeline is situated in an area where the average particle size is smaller than elsewhere in the grind chamber; the external pipe line quality and piping seal requirements are high and costly since both pipe and seals are under high pressure relative to the exterior of the apparatus; adapting an existing jet mill with external return pipe lines requires, for example, new nozzles, new nozzle holders, external piping and associated fittings, additional external mill apertures and recertifying the modified mill for pressure shock resistance.

Although fluidized jet mills can be used to grind a variety of particles, they are particularly suited to grinding other materials, such as toners, used in electrostatographic reproducing processes. These toner materials can be used to form either two component developers, typically combined with a coarser powder of coated magnetic carrier material to provide charging and transport for the toner, or single component developers, in which the toner itself has sufficient magnetic and charging properties that carrier particles are not required. The single component toners are composed of, for example, resin and a pigment such as commercially available MAPICO Black or BL 220 magnetite. Compositions for two component developers are disclosed in, for example, U.S. Pat. Nos. 4,935,326 and 4,937,166 to Creatura et al.

Toners are typically melt compounded into sheets or pellets and processed in a hammer mill to a mean particle size of between about 400 to 800 microns. They are then ground in the fluid energy mill to a mean particle size of between 3 and 30 microns. Such toners have a relatively low density, with a specific gravity of approximately 1.7 for single component and 1.1 for two component toner. They also have a low glass transition temperature, typically less than about 70° C. The toner particles will tend to deform and agglomerate if the temperature of the grinding chamber exceeds the glass transition temperature.

In the aforementioned commonly assigned U.S. Pat. No. 5,133,504 to Smith et al., there is disclosed a fluidized bed jet mill with a grinding chamber with a peripheral wall, a base, and a central target, mounted within the grinding chamber and centered on the chamber central axis. Multiple sources of high velocity gas are mounted in the peripheral wall of the grinding chamber, are arrayed symmetrically about the central axis, and are oriented to direct high velocity gas along an axis intersecting the central axis of the grinding chamber. Each of the gas sources has a nozzle holder, a nozzle mounted in one end of the holder oriented toward the grinding region, and optionally an annular accelerator tube mounted concentrically about the nozzle holder. The end of the accelerator tube closer to the nozzle is larger in diameter than the nozzle holder and the opposite end of the accelerator tube. The accelerator tube and the nozzle holder define between them an annular opening through which particulate material in the grinding chamber can enter and be entrained with the flow of gas from the nozzle and accelerated within the accelerator tube to be discharged toward the impact target centered on the central axis. These embodiments can be combined for further efficiency enhancement. A problem associated with solid body impact target is that the target may suffer mechanical stress and wear from continuous particle bombardment, particularly in an annular area substantially defined by the circular perimeter created by the particle gas stream projected onto the target. The complexities and concomitant economics associated with maintenance and replacement of the target assemblies can be considerable.

Although present fluidized bed jet mill grinding and throughput efficiencies are satisfactory, they could be enhanced to provide a significant improvements and economic advantages, especially energy savings. The aforementioned Siegel and Neu disclosures are directed to mills in which the particles are mixed with gas jet flows that are outside the grinding chamber and as such are not suited for use in a fluidized bed mill. The Smith et al., disclosure is directed to a fluidized bed jet mill apparatus for grinding particles and which grinding is achieved by impinging the particle streams against a solid impact target.

In the aforementioned copending application U.S. Ser. No. 08/409,125 (D/94639), there is disclosed an improved apparatus and method of grinding particles in a jet mill that has a grinding chamber with a peripheral wall, a base, a central axis, and a rigid impact target with a hollow interior or internal cavity, and a plurality of openings or apertures for material transport therethrough and grinding contact therewith. Other embodiments include: having at least one plate type impact target with at least one aperture therethrough, the impact target being mounted within the grinding chamber and centered about an axis and which axis is perpendicular to and intersects the central axis of the grinding chamber.

In the aforementioned copending application U.S. Ser. No. 08/571,664 (D/95414) there is disclosed jet nozzle face plates which enhance jet stream surface area and thereby promote jet mill efficiencies improvements.

While the above mentioned references provide for improvements in grinding efficiency, there is still a need for further improvements in apparatus and methods for enhancing the grinding efficiency of fluidized bed jet mills.

SUMMARY OF THE INVENTION

It is an object of the present invention to overcome deficiencies of prior art devices described above and to provide grinding equipment and grinding processes with improved grinding efficiency and grinder throughput.

It is another object of the present invention, in embodiments, to provide a fluidized bed jet mill for grinding particulate material including a jetting nozzle comprising: a first hollow cylindrical body with a first diameter, for example, a conventional jet mill nozzle, wherein one end of the body is directed towards the center of the jet mill and the other end traverses the wall of the jet mill grinding chamber; and a hollow cylindrical curvilinear body with a diameter which is less than the first diameter, wherein the first end of the curvilinear body is collinear with the long axis of the first hollow cylindrical body, for at least a portion of its length, wherein the first end of the curvilinear body is at a point approximately equal to the end of the first hollow cylindrical body, wherein the second end of the curvilinear body passes through an opening in the side wall of the first hollow cylindrical body, and wherein the side wall opening is leak free and resides within the grinding chamber of the fluid bed mill; and wherein the nozzle communicates the gas stream from the high pressure gas source to the grinding chamber thereby forming at least two particulate gas streams from each nozzle by way of primary entrainment of particles in the chamber at the periphery of the nozzle tip and secondary entrainment of particles by way of the curvilinear body.

In still another object of the present invention is provided, in embodiments, a method of grinding particles comprising: introducing unground particles into a grinding chamber of a fluidized bed jet mill; injecting gas from a plurality of sources of high velocity gas into the grinding chamber through a nozzle or nozzles comprising: a first hollow cylindrical body with a first diameter which provides a conduit for high pressure gas, wherein one end of the body is directed towards the center of the jet mill and the other end traverses the wall of the jet mill; and a hollow cylindrical curvilinear body with a second diameter which is less than the first diameter, wherein the first end of the curvilinear body is collinear with the long axis of the first hollow cylindrical body, wherein the first end of the curvilinear body is at a point approximately equal to the end of the first hollow cylindrical body, wherein the second end of the curvilinear body passes through an opening in the side wall of the first hollow cylindrical body, and wherein the side wall opening is sealed, leak free, and resides within the grinding chamber of the fluid bed mill; wherein the nozzle communicates the gas stream from the high pressure source to the grinding chamber; forming a fluidized bed of the unground particles within the chamber; continuously entraining and accelerating a portion of the unground particles with the high velocity gas to form a high velocity particle gas stream; fracturing the portion of the entrained particles into smaller particles by projecting the particle gas stream against opposing particle gas streams; separating from the unground particles and the smaller particles a portion of the smaller particles smaller than a selected size; discharging the portion of the smaller particles from the grinding chamber; and continuing to grind the remainder of the smaller particles and the unground particles by primary and secondary reentrainment until the smaller particles, smaller than a selected size, are obtained thereby, wherein the high velocity gas stream has a high surface area periphery or profile with larger particles distributed substantially thereon and with smaller particles distributed substantially thereunder, and wherein the relative throughput grinding efficiency is improved from about 1 percent to about 30 percent compared to a mill which does not employ the curvilinear body.

Another object of the present invention provides, in embodiments, a method for grinding particles of electrostatographic developer material comprising: introducing unground particles of electrostatographic developer material into a grinding chamber of a fluidized bed jet mill; injecting gas from a plurality of sources of high velocity gas attached to injecting nozzle comprising: a first hollow cylindrical body with a first diameter, wherein one end of the body is directed towards the center of the jet mill and the other end traverses the wall of the jet mill; and a hollow cylindrical curvilinear body with a second diameter which is less than the first diameter, wherein the first end of the curvilinear body is collinear for at least a portion of its length with the long axis of the first hollow cylindrical body, wherein the first end of the curvilinear body is at a point approximately equal to the end of the first hollow cylindrical body, wherein the second end of the curvilinear body passes through an opening in the side wall of the first hollow cylindrical body, and wherein the side wall opening is sealed air tight, leak free, and resides within the grinding chamber of the fluid bed mill; wherein the nozzle communicates the gas stream from the high pressure gas source to the grinding chamber thereby forming gas stream within the jet mill; forming a fluidized bed of the unground particles in the grind chamber; entraining and accelerating a portion of the unground particles with the high velocity gas stream to form a primary high velocity particle gas stream; fracturing a portion of the accelerated particles into smaller particles by projecting at least two particle streams in partial or complete opposition so that substantially all of the particles accelerated by the gas stream impact particles contained in an opposing stream; entraining and accelerating a portion of the unground particles and smaller partially ground particles from within the grind chamber into and through the second end of the curvilinear body with the high velocity gas to form a secondary high velocity particle gas stream contained within the primary particle gas stream; separating from the unground particles and the smaller particles a portion of the smaller particles smaller than a selected size; discharging the portion of the smaller particles from the grinding chamber; and continuing to grind the remainder of the smaller particles and the unground particles through continuous reentrainment of particles in accordance with the aforementioned entrainment and acceleration steps until the smaller particles, smaller than a selected size, are obtained thereby.

In another object of the present invention, in embodiments, is provided a curvilinear body with a plurality of second ends, for example, from about 2 to about 10 ends, with a manifold for merging the plural ends situated, for example, within the nozzle body.

In yet another object of the present invention, in embodiments, is provided a device, for example a kit, for adapting at least one nozzle of a fluid bed jet mill comprising: a hollow cylindrical curvilinear body with a diameter which is less than the diameter of the nozzle diameter, the curvilinear body is fitted within the nozzle and adapted so that the first end of the curvilinear body is substantially collinear with the long axis of the nozzle; the first end of the curvilinear body is situated at a point approximately equal to the end of the nozzle; the second end of the curvilinear body passes through at least one sealed and leak free opening in the side wall of the nozzle; the side wall opening in the nozzle resides within the grinding chamber of the fluid bed mill; and the throughput efficiency and grinding efficiency are improved by from about 1 to about 30 percent compared to when the curvilinear body is absent.

In still another object of the present invention is provided, in embodiments, a method for grinding particles of electrostatographic developer materials, for example, single and two component developers and toners.

In another object of the present invention is the provision of high efficiency processes and apparatus for grinding particulate materials and which processes and apparatus substantially simplify the grinder system complexity and the costs associated with construction, modification, and operation thereof.

It is an object of the present invention to provide simple and economical processes and apparatus for grinding particulate materials.

Yet another object of the present invention is to provide an increase in the high speed surface available to the for achieving particle acceleration, collision and breakage.

Other objects, features, and advantages of the present invention will be apparent to those of ordinary skill in the art from the following detailed description of the invention.

DETAILED DESCRIPTION OF THE INVENTION

The present invention provides, in embodiments, improvements in the particle jetting efficiency of prior art fluid bed jet mills by employing an improved apparatus and method for grinding particles, specifically, high velocity gas jet nozzles are modified with an internal feed tube which acts as a recirculation conduit which provides advantages as illustrated herein.

The apparatus, in embodiments, comprises a fluidized bed jet mill for grinding particulate material comprising: a grinding chamber having a peripheral wall, a base, and a central axis; an optional rigid or hollow bodied impact target, for example, as disclosed in the aforementioned commonly owned U.S. Pat. No. 5,133,504, or in copending U.S. Ser. No. 08/409,125 (D/94639), the disclosures of which are incorporated by reference in their entirety herein, respectively; and a plurality of sources of high velocity gas, the gas sources being mounted within the grinding chamber or on the peripheral wall, arrayed symmetrically about the central axis, and oriented to direct high velocity gas along an axis substantially perpendicularly intersecting the central axis, the central axis being situated at the intersection of gas streams. Each of the sources of high velocity gas comprises a nozzle having a hollow cylindrical body; and an optional integral face plate member attached to the end of the cylindrical body directed towards the center of the jet mill chamber.

In embodiments, the present invention provides a fluidized bed jet mill for grinding particulate material including a jetting nozzle comprising: a first hollow cylindrical body with a first diameter, for example, a conventional jet mill nozzle, wherein one end of the body is directed towards the center of the jet mill and the other end traverses the wall of the jet mill grinding chamber; and a hollow cylindrical curvilinear body with a diameter which is less than the first diameter, wherein the first end of the curvilinear body is collinear with the long axis of the first hollow cylindrical body, for at least a portion of its length, wherein the first end of the curvilinear body is at a point approximately equal to the end of the first hollow cylindrical body, wherein the second end of the curvilinear body passes through an opening in the side wall of the first hollow cylindrical body, and wherein the side wall opening is leak free and resides within the grinding chamber of the fluid bed mill; and wherein the nozzle communicates the gas stream from the high pressure gas source to the grinding chamber thereby forming at least two particulate gas streams from each nozzle by way of primary entrainment of particles in the chamber at the nozzle tip and secondary entrainment of particles by way of the curvilinear body.

Figure 1:
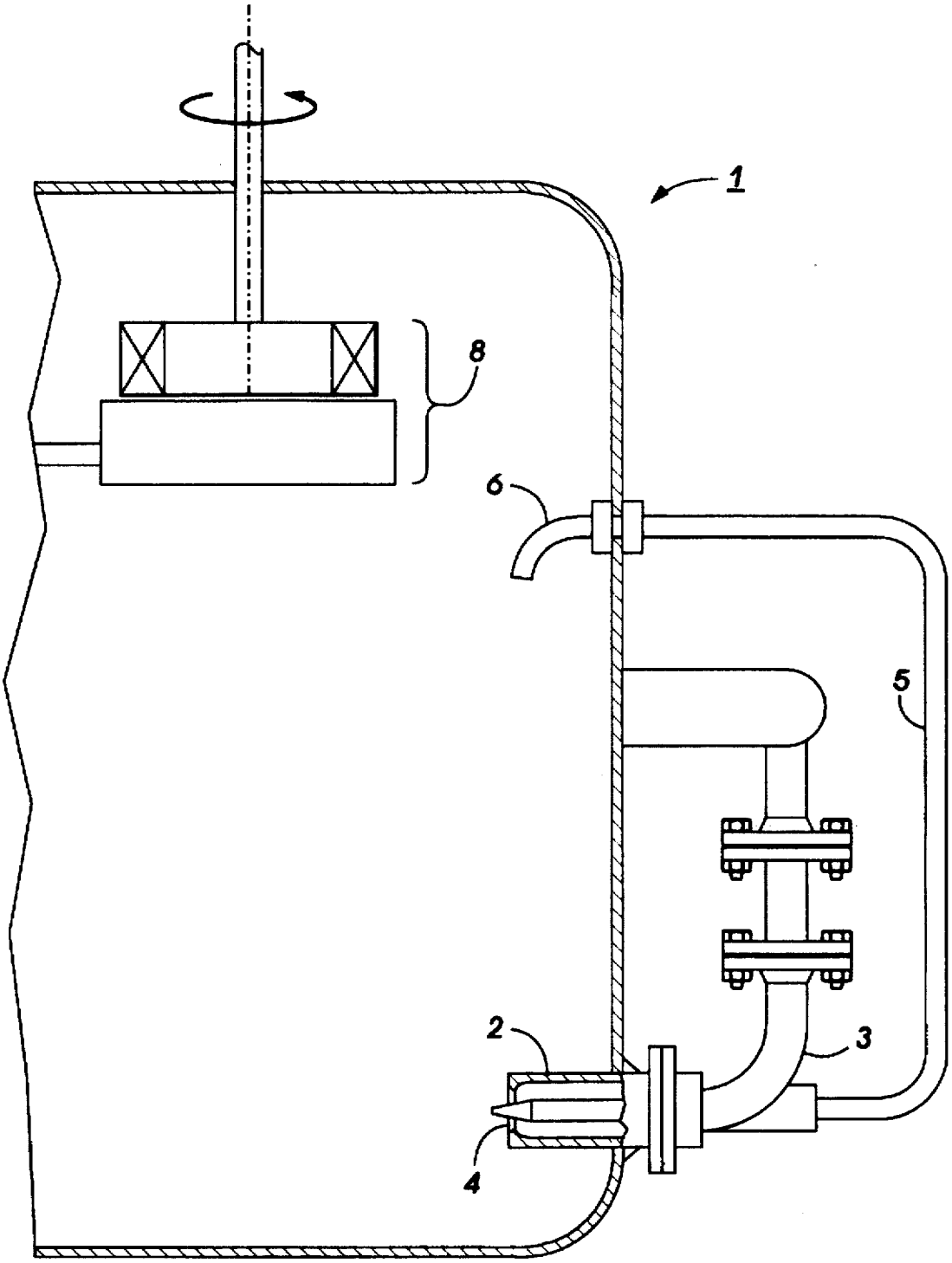
FIG. 1 PRIOR ART
FIG. 1 is a schematic representation in section of a commercially available fluid bed jet mill which allows for recirculation of particles from the classification region of the mill to the grind section of the mill via an external conduit and nozzle member, as disclosed in the prior art.

With reference to Figures, there are illustrated in FIG. 1 a schematic of a commercially available apparatus available from CONDUX GmbH, a fluid bed grinder 1 equipped with a jetting nozzle 2, and a source manifold 3 of high pressure air is further equipped with a central feed tube 4 and an externally mounted return tube member 5 and inlet port 6 which enables transport of particulate material from the classification region 8 of the fluid bed back to the nozzle 2 and tube 4 and then to the grind section of the mill.

Figure 2:
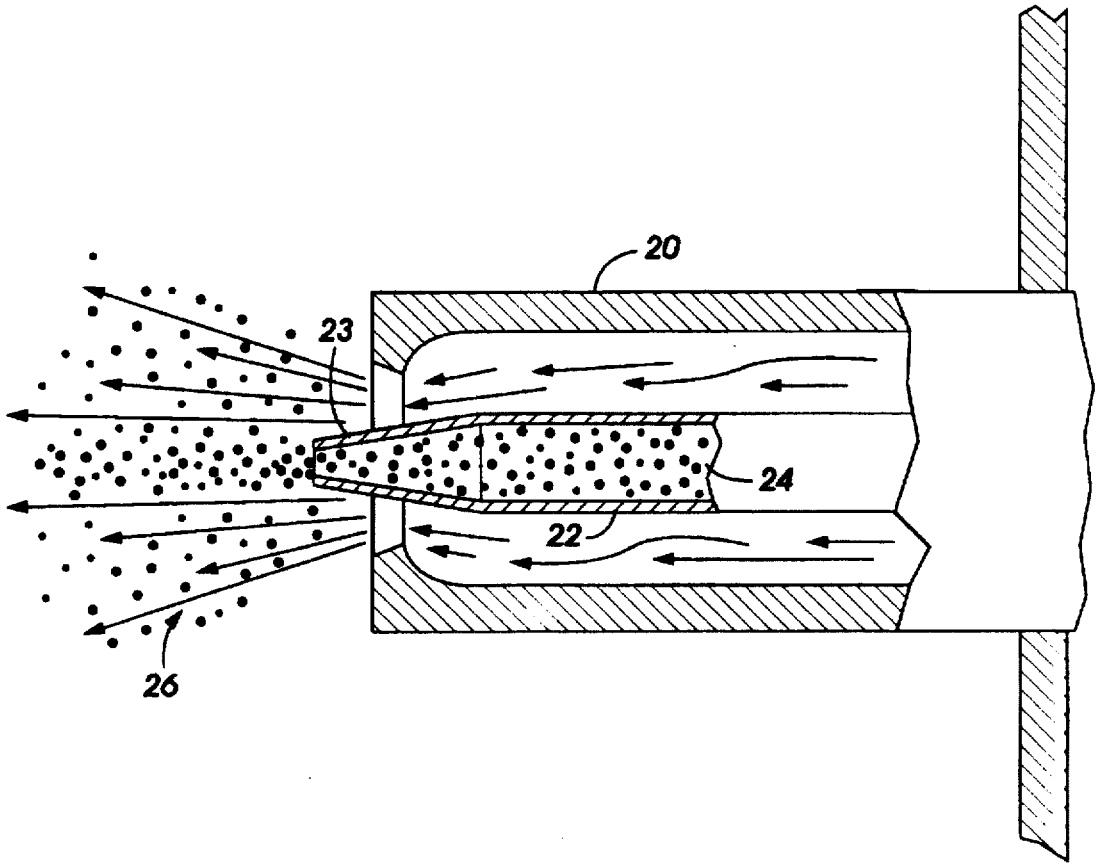
FIG. 2 PRIOR ART
FIG. 2 is a schematic representation in section of the nozzle region of the fluid bed jet mill of FIG. 1 that readmits particles to the grind chamber after external recirculation of particles, as disclosed in the prior art.

FIG. 2 is a schematic representation in section of the nozzle region 20 of the fluid bed jet mill of FIG. 1 which admits high pressure air (arrows) and particles to the grind chamber after external recirculation resulting in particle entrainment 26 in the air jet stream and thereby producing a gas-particle stream comprised of presumably of internally circulated particles on the periphery and externally recirculated particles on the interior of the stream.

Figure 3:
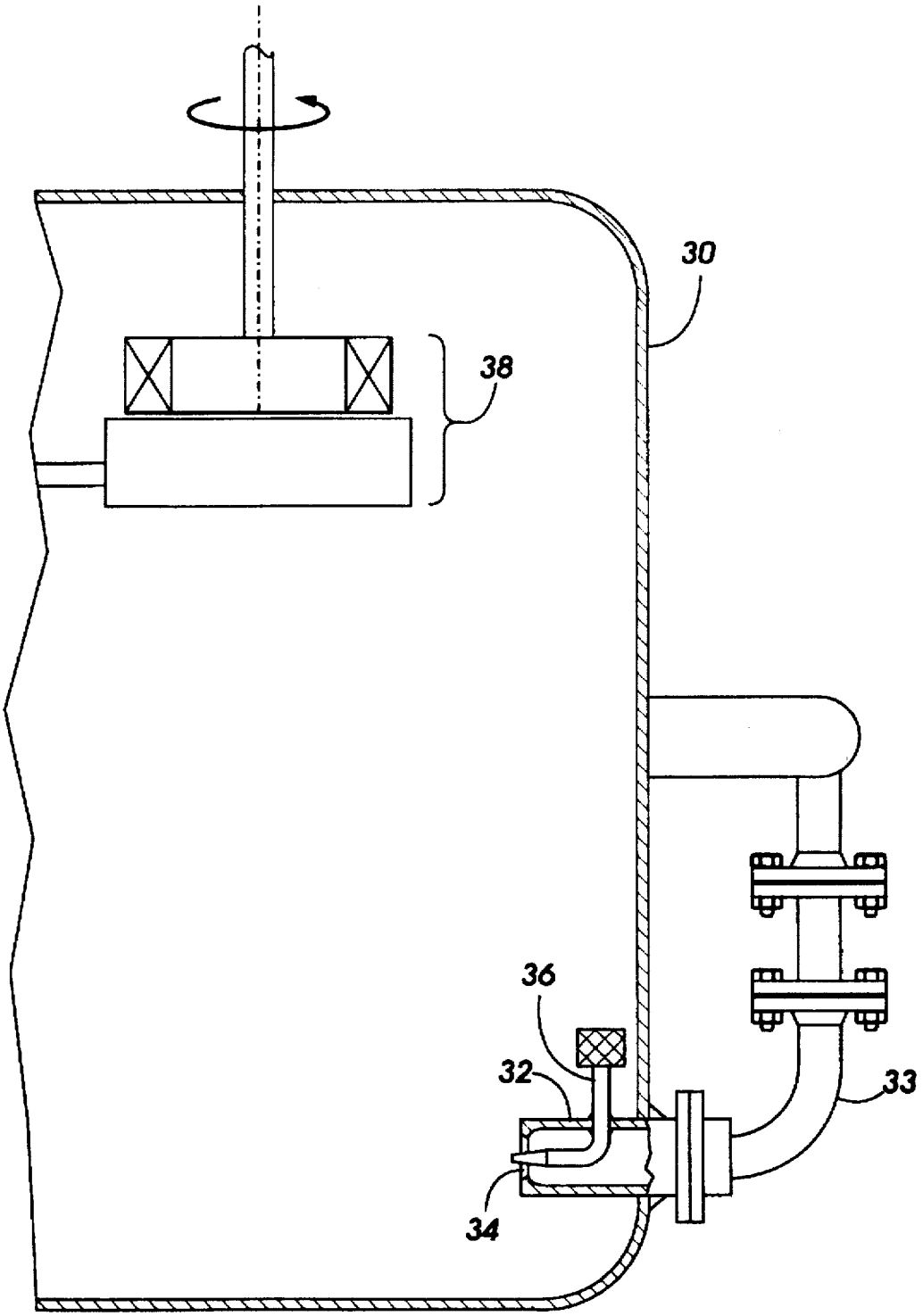
FIG. 3 is a schematic representation in section of a fluid bed jet mill which has been adapted with componentry in accordance of the present invention for internal recirculation of particles from the grinding chamber grind section of the mill through a nozzle member which directly returns the particles to the mill via an internal conduit or curvilinear body of the present invention.

FIG. 3 is a schematic representation in section, in embodiments of a fluid bed jet mill 30 which has been adapted with componentry in accordance of the present invention for internal recirculation of particles from the grinding chamber grind region of the mill through jetting nozzle member 32. High pressure air is supplied through source manifold 33 which is further adapted with internally mounted central feed tube 34 comprising a first end opening or tip, tube extension 36, and a filter member affixed to the second end thereof. The configuration enables particles to be directly returned to the mill grind section via an internal conduit 34 or curvilinear body prior to particles reaching the classification section 38 and without the need for the external return tube as is the situation with the aforementioned commerically available apparatus as described in FIGS. 1 and 2.

Figure 4:
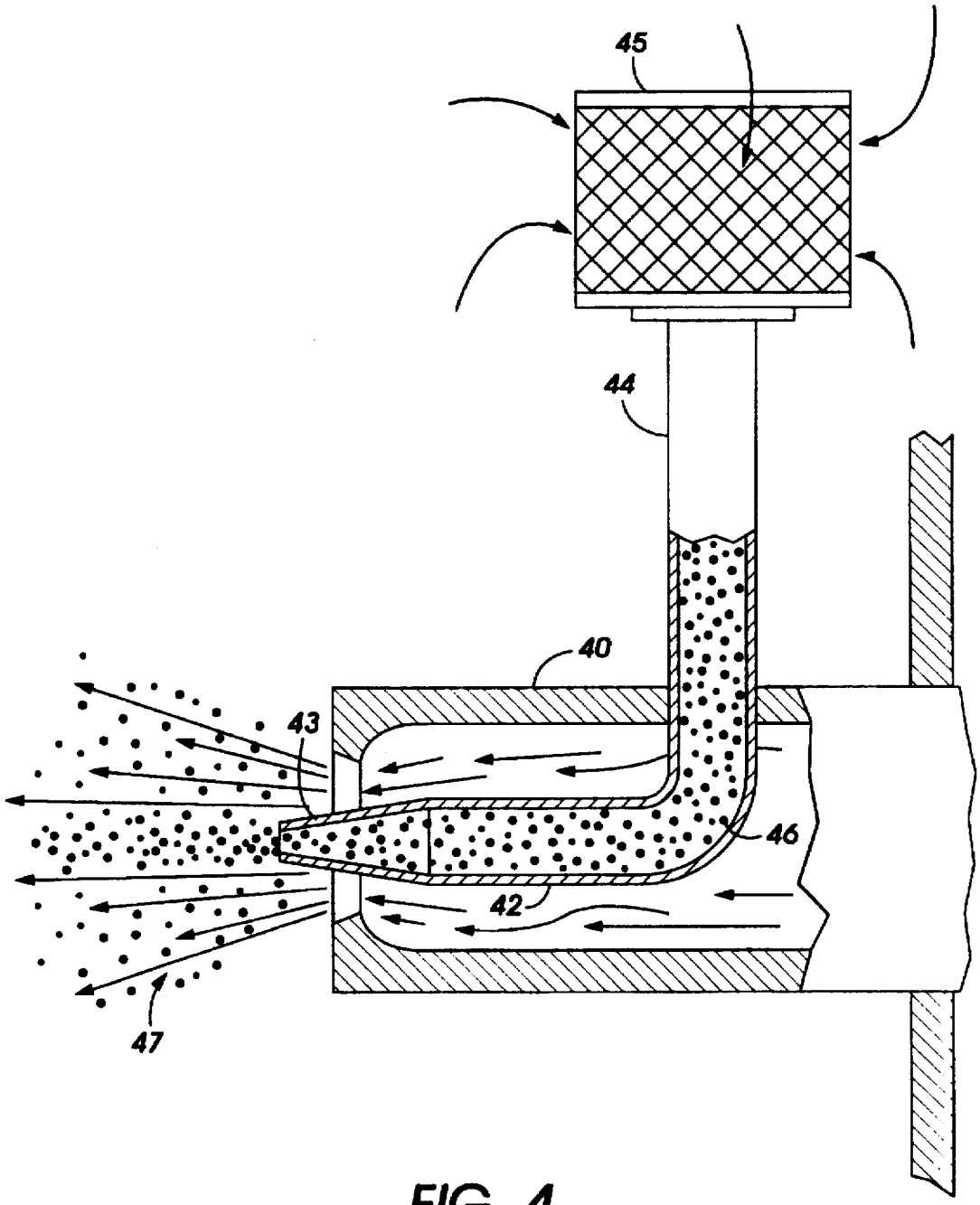
FIG. 4 is a schematic representation in section of the nozzle region of the fluid bed jet mill of FIG. 3 that has been adapted, in embodiments of the present invention, with a curvilinear recirculation means.

FIG. 4 is a schematic representation in section of the nozzle region 32 of the fluid bed jet mill of FIG. 3 wherein nozzle 40 has been adapted, in embodiments of the present invention, with a curvilinear recirculation tube member 42 having a first end opening 43, extension 44, filter or screen member 45 which prevents recirculated particles 46 from lodging in or clogging the recirculation tube 42 and enables continuous internal reentrainment of particles and high particle grinding efficiency of particle-gas stream 47.

Figure 5:
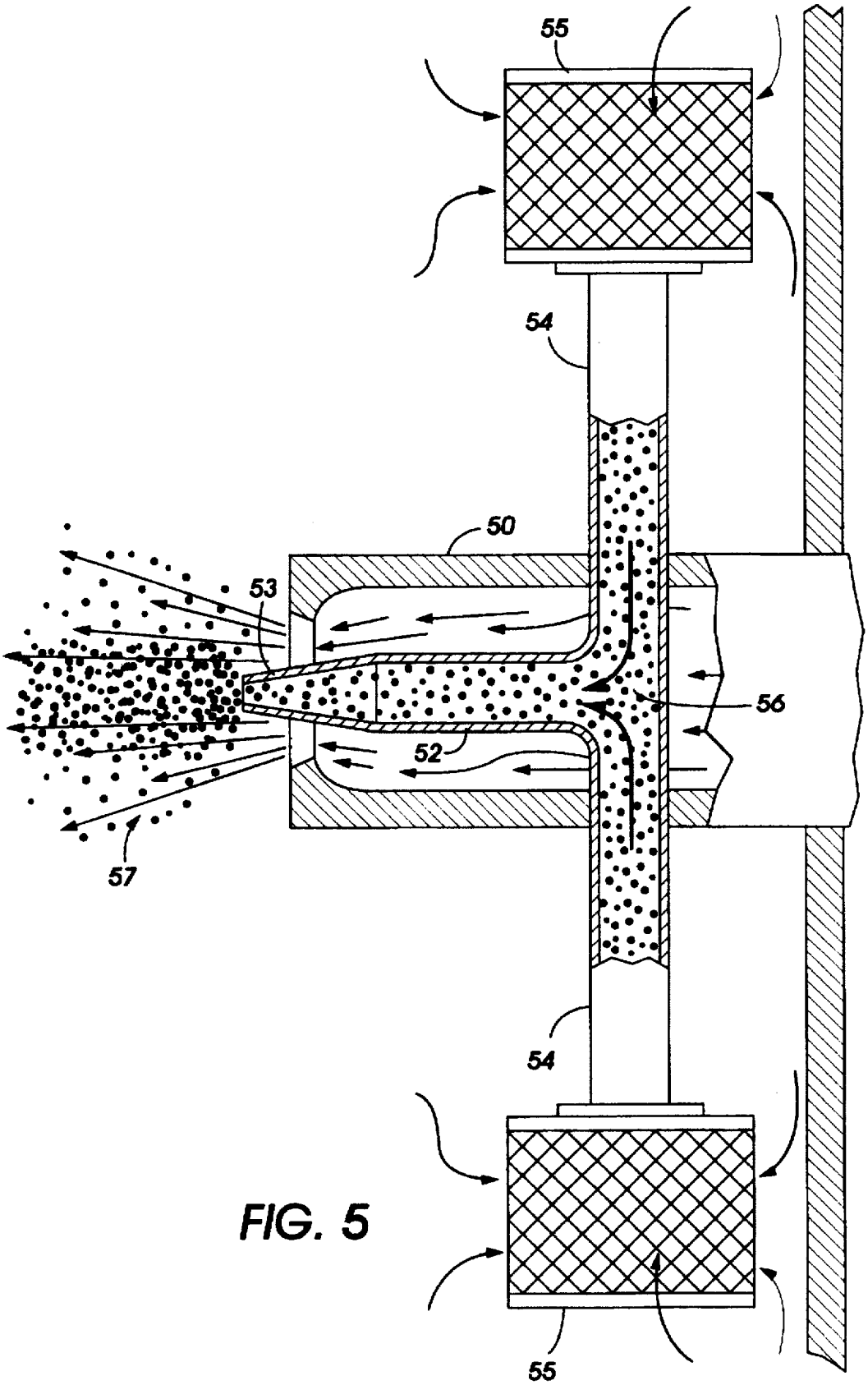
FIG. 5 is a schematic representation in section of the nozzle region of the fluid bed jet mill of FIG. 3 that has been adapted, in embodiments of the present invention, with a curvilinear recirculation means which has a plurality of second ends.

FIG. 5 is a schematic representation in section of the nozzle region 32 of the fluid bed jet mill of FIG. 3 that has been adapted, in embodiments of the present invention, with a curvilinear recirculation tube member 52 having a first end opening 53, tube extension members 54, filter or screen members 55 which prevent recirculated particles 56 from lodging in or clogging the recirculation tube 52 and enables high efficiency continuous internal reentrainment of particles and high particle grinding efficiency of particle-gas stream 57. It should be evident to one of ordinary skill in the art upon inspection of FIG. 5 and as disclosed herein, that the second end of the curvilinear body 52, in embodiments, can be comprised of a plurality of ends, for example, from about 2 to about 10 ends. In the configuration shown and other related plural second end embodiments, each second end can be attached, internally or externally, to the cylindrical body or nozzle 50, wherein the curvilinear body 52 is fixed, in such a robust configuration, that an internal support member is optional or is not necessary to maintain the positional and operational integrity of the curvilinear return tube 52.

As should be evident from the foregoing discourse, although not wanting to be limited by theory it is believed that a gas stream passing through a nozzle opening or openings, continuously sweeps along the first end of the curvilinear body creating a negative pressure or vacuum within, which in turn causes particles less than the size of the diameter of the diameter of the curvilinear body to be drawn into and thereafter delivered to the nozzle tip thereby creating a particle entrainment surface area or areas.

In embodiments, the second end of the curvilinear body can be flush with the internal or external wall of the first hollow cylindrical body.

In embodiments, the second end of the curvilinear body can extend beyond the wall of the first hollow cylindrical body.

In embodiments, a filter member may be optionally affixed to the second end of the curvilinear body to minimize the possibility of blockage of the curvilinear body.

The filter member can comprise, for example, a wire mesh or screen having openings therethrough of from about 50 microns to about 3,000 microns. In embodiments, a suitable filter mesh size selected was 500 microns. In embodiments, a filter mesh size is selected which is approximately less than about one half the internal diameter of the second end of the curvilinear tube.

The term "curvilinear body" refers to the nozzle tube insert, and can also be referred to as a central feed tube.

The term "Laval" is a term of art named after its inventor, and refers to a converging-diverging nozzle, reference the air jet nozzle tip structure in the figures, which is capable of producing supersonic gas jet flow patterns as in the present invention.

In embodiments, the jet nozzle and curvilinear body can further comprise a support member which connects the curvilinear body to the cylindrical body.

The curvilinear body is integral with, or can be attached to, the cylindrical body by any suitable means. In an embodiment, a support member resides inside of the hollow cylindrical body and is attached to the internal wall of the cylindrical body in at least one point and is connected to the curvilinear body in at least one point which resides within the hollow cylindrical body. In another embodiment, the support member can affix the curvilinear body to the external or outer wall of cylindrical body. The support member further connects the curvilinear body to the cylindrical body at least one additional point to provide additional support; the first point of connection or primary connection is at a point where the curvilinear body passes through an opening in the wall of the cylindrical body and wherein the opening is within the grinding chamber. The first point of connection or fastening of the curvilinear body to the cylindrical body can be accomplished in any suitable manner which is compatible with the highly abrasive conditions present within the grinding chamber, for example, a flux weld, an impact and abrasion resistant adhesive, such as a thermoset or reinforced epoxy cement, ceramet bonding materials, a clamp or combination of clamps, and the like fastening methods. Both the primary connection and the support member maintain the stability and longevity of the relationship between the curvilinear body and the cylindrical body, so that the high pressure gas stream passing through the cylindrical body or main nozzle will provide a sufficiently high dynamic pressure to induce the entrainment of particles from within the grind chamber into and through the curvilinear body.

A function of the second end of the hollow cylindrical curvilinear body is to entrain particles circulating within the grind chamber region of the jet mill at the second end into the curvilinear body and thereafter substantially into the center of a gas stream egressing through the first cylindrical body.

In embodiments, grinding efficiency or throughput efficiency of the mill is increased by from about 1 to about 30 percent compared to an equivalent mill which does use a curvilinear body to modify the jet nozzles.

In embodiments, grinding or throughput efficiency of a mill using, for example, three nozzles modified in accord with the present invention can be increased by at least 5 percent compared to an equivalent mill which does use the curvilinear body.

In other embodiments, to prevent particulate clogging or fouling of the curvilinear body, the second end of the curvilinear body can be optionally fitted with a wear resistant and resilient particle anti-caking member, reference copending application U.S. Ser. No. 08/327,734 (D/94585), filed Oct. 10, 1994, entitled "EDUCTOR LINER ARTICLE AND METHOD OF USE", which discloses an eductor liner article comprising: a flexible and substantially cylindrically shaped sleeve member with upstream and downstream ends; and a flange collar member adjacent and perpendicularly attached at an internal edge or surface to the upstream end of the sleeve member, wherein the flange collar member anchors the liner in an eductor joint, and wherein the liner eliminates or substantially reduces the deposition and accumulation of particulate material contained in a process stream educing through an eductor member in the vicinity of the eductor joint.

Although not wanting to be limited by theory, it is believed that the above mentioned liner can be readily adapted for use in preventing particle blocking in the curvilinear members of the present invention.

Further, although not wanting to be limited by theory, it is also believed that a gas stream passing through the first hollow body causes particles to flow through the curvilinear body forming a first gas particle stream, wherein the first gas particle stream has particles which are substantially contained within a region defined by the surface of the gas stream, and upon entering the grind chamber of the mill the first gas particle stream further entrains particles which are present in the chamber to form a second gas particle stream, and wherein the particles entrained in the chamber are located substantially on the surface of the gas stream.

In embodiments, the first end of the curvilinear body is at a point which is greater than the end of the first hollow cylindrical body so that substantially no particles contact the inner wall of the first cylindrical body.

In embodiments, the first end of the curvilinear body is situated at a point which is less than the end of the first hollow cylindrical body so that the gas stream passing through the first cylindrical body contains particles prior to entering the chamber.

Although not wanting to be limited by theory, it is believed that particles in the particulate gas stream arising from the primary gas stream egressing from the first cylindrical body are substantially concentrated in a peripheral annulus, and particles in the secondary particulate gas stream arising from the gas and particles entrained in and passing through the curvilinear body are concentrated substantially in an internal annulus.

In embodiments, the relationship between the bodies can be described, for example, as the ratio of the diameters of the first cylindrical body and the second curvilinear body and is from about 1.0:0.05 to about 1.0:0.95.

In embodiments, at least one jetting nozzle is present and modified in accordance with the present invention and wherein the relative throughput efficiency and grinding efficiency of the mill is improved by from about 1 to about 30 percent depending upon the material selected for grinding and the nominal particle size desired.

In still other embodiments of the present invention there is provided, a method of grinding particles comprising: introducing unground particles into a grinding chamber of a fluidized bed jet mill; injecting gas from a plurality of sources of high velocity gas into the grinding chamber through a nozzle or nozzles comprising: a first hollow cylindrical body with a first diameter which provides a conduit for high pressure gas, wherein one end of the body is directed towards the center of the jet mill and the other end traverses the wall of the jet mill; and a hollow cylindrical curvilinear body with a second diameter which is less than the first diameter, wherein the first end of the curvilinear body is collinear with the long axis of the first hollow cylindrical body, wherein the first end of the curvilinear body is at a point approximately equal to the end of the first hollow cylindrical body, wherein the second end of the curvilinear body passes through an opening in the side wall of the first hollow cylindrical body, and wherein the side wall opening is sealed, leak free, and resides within the grinding chamber of the fluid bed mill; wherein the nozzle communicates the gas stream from the high pressure source to the grinding chamber; forming a fluidized bed of the unground particles within the chamber; continuously entraining and accelerating a portion of the unground particles with the high velocity gas to form a high velocity particle gas stream; fracturing the portion of the entrained particles into smaller particles by projecting the particle gas stream against opposing particle gas streams; separating from the unground particles and the smaller particles a portion of the smaller particles smaller than a selected size; discharging the portion of the smaller particles from the grinding chamber; and continuing to grind the remainder of the smaller particles and the unground particles by primary and secondary reentrainment until the smaller particles, smaller than a selected size, are obtained thereby, wherein the high velocity gas stream has a high surface area periphery or profile with larger particles distributed substantially thereon and with smaller particles distributed substantially thereunder, and wherein the relative throughput grinding efficiency is improved from about 1 percent to about 30 percent compared to a mill which does not employ the curvilinear body.

In embodiments, the present invention provides a method for grinding particles of electrostatographic developer material comprising: introducing unground particles of electrostatographic developer material into a grinding chamber of a fluidized bed jet mill; injecting gas from a plurality of sources of high velocity gas attached to injecting nozzle comprising: a first hollow cylindrical body with a first diameter, wherein one end of the body is directed towards the center of the jet mill and the other end traverses the wall of the jet mill; and a hollow cylindrical curvilinear body with a second diameter which is less than the first diameter, wherein the first end of the curvilinear body is collinear for at least a portion of its length with the long axis of the first hollow cylindrical body, wherein the first end of the curvilinear body is at a point approximately equal to the end of the first hollow cylindrical body, wherein the second end of the curvilinear body passes through an opening in the side wall of the first hollow cylindrical body, and wherein the side wall opening is sealed air tight, leak free, and resides within the grinding chamber of the fluid bed mill; wherein the nozzle communicates the gas stream from the high pressure gas source to the grinding chamber thereby forming gas stream within the jet mill; forming a fluidized bed of the unground particles in the grind chamber; entraining and accelerating a portion of the unground particles with the high velocity gas stream to form a primary high velocity particle gas stream; fracturing a portion of the accelerated particles into smaller particles by projecting at least two particle streams in partial or complete opposition so that substantially all of the particles accelerated by the gas stream impact particles contained in an opposing stream; entraining and accelerating a portion of the unground particles and smaller partially ground particles from within the grind chamber into and through the second end of the curvilinear body with the high velocity gas to form a secondary high velocity particle gas stream contained with the primary particle gas stream; separating from the unground particles and the smaller particles a portion of the smaller particles smaller than a selected size; discharging the portion of the smaller particles from the grinding chamber; and continuing to grind the remainder of the smaller particles and the unground particles through continuous reentrainment of particles in accordance with the aforementioned entrainment and acceleration steps until the smaller particles, smaller than a selected size, are obtained thereby.

In another object of the present invention, in embodiments, is provided a curvilinear body with a plurality of second ends, for example, form about 2 to about 10 ends, with a manifold for merging the plural ends situated, for example, within the nozzle body.

In embodiments, the combined jet nozzle and the internal and central feed tube of the present invention can optionally employ an integral face plate member attached to the end of the first cylindrical body or to a nozzle tip.

In embodiments, the unground particles are electrostatographic developer material particles with a mean volume diameter of about 50 to about 10,000 microns and the smaller ground particles have a mean volume diameter of about 3 to about 30 microns.

In other embodiments, the particulate material for grinding can be toner particles, pigment particles, resin particles, toner surface additive particles, toner charge control additives, uncoated carrier particles, resin coated carrier particles, metal oxide particles, surface treated metal oxide particles, mineral, and mixtures thereof.

In embodiments, the combination of the cylindrical nozzle body and the curvilinear body can further comprise a funnel shaped member affixed to one or more of the second ends of the curvilinear body, and wherein the funnel shaped member is believed to facilitate admission of particles to, and through, the curvilinear body.

In embodiments of the present invention, there is provided a device, for example in the form of a kit, for adapting at least one nozzle of a conventional fluid bed jet mill with an internally mounted and central feed tube for achieving improved mill throughput and grinding efficiencies, and as illustrated herein, wherein the kit comprises: a hollow cylindrical curvilinear body with a diameter which is less than the diameter of the nozzle diameter, the curvilinear body is fitted to the nozzle and adapted so that the following conditions are satisfied: the first end of the curvilinear body is substantially collinear with the long axis of the nozzle in the region of the nozzle tip; the first end of the curvilinear body is at a point approximately equal to the end of the nozzle; the second end of the curvilinear body passes through a leak free opening in the side wall of the nozzle; the side wall opening in the nozzle resides within the grinding chamber of the fluid bed mill and can be formed by, for example, molding, machining, and the like; and the throughput efficiency and grinding efficiency is improved by from about 1 to about 30 percent compared to when the curvilinear body is absent.

An existing nozzle holder can be modified or adapted in accordance with the present invention by creating at least one perforation or hole through the wall of the nozzle through which a feed tube can be fitted. The feed tube is preferably installed so that substantially at least the first end of the tube retains an approximately collinear relationship with the nozzle axis, by means of, for example, an optional support member or a suitable fastening means. The nozzle opening can be enlarged to provide the same or similar cross section surface area at the narrowest section so as to maintain a constant gas flow therethrough when a central feed tube is in situ and operational. The aforementioned fastening means used to fix the central feed tube into position and to the nozzle or nozzle holder is preferably selected so that the central feed tube can be readily removed from the nozzle or nozzle holder, for example, during routine maintenance or when the nozzle or nozzle holder are replaced or serviced.

The first end of the central feed tube, in embodiments, can be flush, inside of, or can protrude beyond the front face of the nozzle element. The location of the first end of the feed tube can contribute to improved grinding efficiency and can depend on a number of variables such as rheological properties of the material being ground; gas properties including temperature gas pressure; initial, intermediate, nominal, and final particle sizes, and the like. In an embodiment, the first end of the central feed tube protrudes beyond the front face of the nozzle by about 0.5 millimeters.

In embodiments, where plural second ends are selected, as the number of plural second ends increase, the mechanical support afforded thereby increase and the disruption, diversion, or constriction of the nozzle internal transport area decreases. In general, a series of optimization experiments can be used to maximize this relation in accomplishing greatest mill efficiencies.

A principal function of the modified nozzle configuration with internal return capability of the present invention is to provide a gas stream surface area that enables grinder bed particulate materials access to the interior surface area of the resultant gas stream. The entrainment of particles into the internal surface area of the gas stream is accomplished directly and efficiently with the aforementioned internal return central feed tube. The present invention thus provides in embodiments enhanced throughput efficiency and substantially simplifies the fluid bed jet mill complexity and cost of construction and operation.

In other embodiments, the aforementioned modified nozzles with internal curvilinear return or feed capability, can be used in conjunction with, for example: one or more apertured impact targets of the type described in the aforementioned copending U.S. Ser. No. 08/409,125, wherein the aperture of the target preferably matches the geometry and dimensions of the nozzle opening; and with accelerator tubes of the type described in the aforementioned copending U.S. Ser. No. 08/409,125 and the commonly owned U.S. Pat. No. 5,133,504, the disclosures of which are incorporated herein by reference in their entirety.

The thickness of the wall of the aforementioned curvilinear body or internally fed central feed tube, can be, in embodiments, from about 0.01 to about 30 millimeters, and which size may be determined from consideration of, for example, the contemplated gas velocity, particle size, particle type, desired particle size reduction levels, and throughput volumes and throughput efficiencies desired, the abrasiveness of the particulate material, desired service life, presence or absence of protective surface coatings, and the presence or absence of, for example, solid or hollow body targets or aperture plate type targets.

In embodiments of the present invention, particle size reduction is accomplished by, for example, particle-stationary wall impingement and particle-particle stream impingement. Thus, improved material throughput efficiency and power consumption efficiencies are realized and are believed to be improved because of the aforementioned enhanced gas stream entrainment surface area afforded by the curvilinear body or internal central feed tube combined with the action of the particle-target impingement and/or particle-particle impingement processes. The relative throughput efficiency improvements are, in embodiments, from about 1 to about 30 percent, and relative throughput efficiency increases or improvements from about 2 to in excess of about 50 percent are believed to be attainable. Exemplary throughput improvements of the present invention are demonstrated hereinafter.

The particulate material suitable for grinding and particle size reduction in the present invention can be toner, developer, resin, resin blends and alloys, filled thermoplastic resin composite particles, minerals, and the like particles. In preferred embodiments, the particulate material is toner particles, pigment particles, resin particles, toner charge control additives, uncoated carrier particles, resin coated carrier particles, and mixtures thereof. Unground feed particles are preferably electrostatographic developer material particles with a mean diameter of about 50 to about 10,000 microns. The smaller or ground particles removed from the grinding chamber and process have a mean diameter of about 3 to about 30 microns. The parameters required to achieve desired particle size properties can be determined empirically and is a preferred practice in view of the large number of process variables.

Ground particles are suitable for use as electrostatographic developer material selected from the group consisting of single component and two component toner particles comprising a binder resin, a pigment, and optional additives. A suitable binder resin for particle size reduction in the present invention can have, for example, a broadly distributed molecular weight centered about approximately 60,000.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLES

Three trials were conducted on the CONDUX CGS-50 fluid bed grinder. The objective of these trials was to evaluate the effectiveness of the laval nozzle with central feed tube adapted for internal return of the present invention. The material used for the trials was derived from extruded toner flake material used in preparing, for example, Xerox Corporation Model 5090™ toner powders. The CONDUX CGS-50 grinder was set up with a 100 mm wheel insert and was run at 100 psig grinding pressure. For all Example runs, a volume average particle size of about 9.4 microns was targeted and substantially achieved. Throughput rates and particle size data were recorded every 15 minutes and 6 points at each condition were recorded.

Example I

Laval Nozzle with Internal Central Feed Tube A working prototype model is comprised of a convergent/divergent nozzle jet with a internal return tube which is coaxially and centrally mounted, and has one end located at the nozzle opening, directed towards a central vertical axis residing in the grinder chamber. The other end, or second end, of the tube is also open to the interior of the mill chamber which allows circulating particulate material in the grinding chamber bed to drawn into the second open end of the tube which particulate material is thereby accelerated and travels through the full length of the tube and thereafter expelled from the first tube end into the center of the jet stream. An existing nozzle with a throat diameter of 8.5 mm provides the support means for the central feed tube. A 3/16" stainless steel tube is milled down to an outer diameter of 4.5 mm wherein there is an annular 2 mm gap around the tube for the high pressure air jet to pass and thereby create negative pressure within the central feed tube in accordance with Bernoulli's effect. The negative pressure within the tube provides a vacuum force which draws particles into the tube at the opposite second end. Since the passage of high pressure air flow through the nozzle fitted with a central feed tube is expected to be comparable to, but not equal, to that of a standard 7.5 mm nozzle used in commercial operation of the mill, the throughput rates are compared on a 'per air flow' basis. The airflow is measured in standard cubic feet per minute (SCFM) and the throughput of ground material is measured in lbs/hr, so that the comparative throughput rate per airflow is expressed in "lbs/hr per SCFM".

Example II

Laval Nozzle with Internal Central Feed Tube Including Filter Element A modification to the aforedescribed apparatus was made by including a filter screen element at the second end of the central feed tube for the purpose of filtering or preventing large particles from entering the tube and potentially plugging the central feed tube. The filter element has a surface area which was considerably larger that that of the tube, so that the filter element has a relatively low face velocity, which allows the larger particles to be swept away by the air current within the fluid bed grinder.

Comparative Example III

As a comparative example to demonstrate the influence of the presence of a non functional feed tube, the internally fed central tube of EXAMPLE I was capped off with a plug, for example a rubber, metal or ceramic stopper, that forms a complete seal such that no material in the bed chamber is drawn into or through the tube and therefore no material or air is entrained into the center of the jet. The results were compared to Examples I and II in Table 1, and appear to indicate a decrease in throughput efficiency.

Comparative Example IV

The nozzles described in Example II, and Comparative Examples III and IV were tested under typical and comparable grinding conditions and the results are tabulated in Table 1. The plugged or capped second end central feed tube control (Comparative Example III) resulted in about a 7 percent decrease in grinding performance relative to Comparative Example IV which is believed to be due to the presence of the capped or sealed return tube, while open end tube Example, is fitted with a filter screen (Example II) at the second tube end, consistently resulted in about a 7 percent increase in grinding performance relative to Comparative Example IV, which is believed to result from the action (recirculation) of the internal feed tube. Comparative Example IV shows the mill grinding performance for the same fluid bed jet mill which has none of the aforementioned modifications, that is, no central feed tube is present. No significant differences in particle size distributions were detected between the Comparative Examples III and IV, and Example II.

TABLE 1

| Example | Product Volume[1] | Throughput Rate[2] | Air Flow Rate[3] | Throughput per Air Flow[4] | Percent Efficiency[5] |
|---|---|---|---|---|---|
| II | 9.4 | 54 (± 2.6) | 500 | 0.109 | 107 |
| Comp. Ex. III | 9.3 | 47 (± 0.8) | 500 | 0.094 | 93 |
| Comp. Ex. IV | 9.4 | 53 (± 1.4) | 520 | 0.102 | 100 |

[1] Product Volume Median (microns)
[2] Throughput Rate in lbs/hour
[3] Air Flow Rate (SCFM)
[4] Throughput Rate per Air Flow (lbs/hr/SCFM)
[5] Percent of Control, i.e. Comparative Example IV At the completion of each trial, the nozzles and tubes were inspected for wear and damage. None of the hardware comprising the central tube and nozzle combination showed any sign of significant damage beyond normal wear experienced by the control. The tubes continued to be concentric to the nozzles and bluing applied to the nozzle and tube prior to starting the trial showed no significant wear on the section of the central tube protruding through the nozzle. The filter assemblies used to limit the size of the material entering the tube also showed no damage or wear.

Example IV

PRODUCTION SCALE EMBODIMENT An Alpine 800 AFG fluid bed grinder is configured with a central feed tube in accordance with Example I and as shown in FIGS. 3 and 4 using, for example, a 16 mm nozzle and a return central feed tube with a diameter of about 7.7 mm. The use of a central feed tube with a larger diameter enables the grinder to operate with improved efficiency even in the absence of a filter screen.

The feed material is, for example, a Xerox Model 5090™ two component toner wherein the toner is comprised, by weight, of approximately one fifth magnetite such as MAPICO Black™, one twentieth carbon black, such as REGAL 330®, and three quarters binder resin of poly (styrene butadiene) having a broadly distributed molecular weight centered about 60,000. The toner was ground from an initial mean diameter of 7,500 microns to a final mean diameter of approximately 10 microns.

The aforementioned patents and publications are incorporated by reference herein in their entirety.

Other modifications of the present invention may occur to those skilled in the art based upon a review of the present application and these modifications, including equivalents thereof, are intended to be included within the scope of the present invention.

What is claimed is:

1. A fluidized bed jet mill for grinding particulate material including a grinding chamber with walls and a center and a jetting nozzle comprising:

a first hollow cylindrical body comprised of a first diameter, a long axis, a side wall with an opening therein, and a first end and a second end, wherein the first end of the first hollow cylindrical body is directed towards the center of the jet mill chamber and the second end of the first hollow cylindrical body traverses the wall of the jet mill chamber; and a hollow cylindrical curvilinear body comprised of a first end, a second end, a long axis and a second diameter which is less than said first diameter of said first hollow cylindrical body, wherein the first end of the first hollow curvilinear body is collinear with the long axis of said first hollow cylindrical body, wherein the first end of the hollow cylindrical curvilinear body is at a point approximately equal to the end of the first hollow cylindrical body, wherein the second end of the hollow cylindrical curvilinear body passes through the opening in the side wall of said first hollow cylindrical body, and wherein said side wall opening is leak free and resides within the grinding chamber of the fluid bed mill; wherein the nozzle communicates the gas stream from a high pressure source to the grinding chamber, and wherein the jet mill has improved grinding efficiency or throughput efficiency properties compared to a jet mill without said curvilinear body.

2. A jet mill in accordance with claim 1 wherein the second end of the hollow cylindrical curvilinear body is flush with the wall of the first hollow cylindrical body.

3. A jet mill in accordance with claim 1 wherein the second end of the hollow cylindrical curvilinear body extends beyond the wall of the first hollow cylindrical body.

4. A jet mill in accordance with claim 1 further comprising a filter member affixed to said second end of the hollow cylindrical curvilinear body.

5. A jet mill in accordance with claim 4 wherein the filter member comprises wire mesh having openings therethrough of from about 50 microns to about 3,000 microns.

6. A jet mill in accordance with claim 1 further comprising a support member which connects the hollow cylindrical curvilinear body to the first hollow cylindrical body.

7. A jet mill in accordance with claim 1 wherein said second end of the hollow cylindrical curvilinear body entrains particles circulating within the grind chamber region of the jet mill into substantially the center of a gas stream egressing through the first hollow cylindrical body.

8. A jet mill in accordance with claim 1 wherein grinding efficiency or throughput efficiency of the mill is increased by from about 1 to about 30 percent compared to an equivalent mill which does not use said curvilinear body.

9. A jet mill in accordance with claim 1 wherein grinding or throughput efficiency of the mill is increased by at least 5 percent compared to an equivalent mill which does not use said curvilinear body.

10. A jet mill in accordance with claim 1 further comprising fitting within said second end of the hollow cylindrical curvilinear body a wear resistant and resilient particle anti-caking member.

11. A jet mill in accordance with claim 1 wherein a gas stream passing through the first hollow cylindrical body causes particles to flow through the hollow cylindrical curvilinear body forming a first gas particle stream, wherein the first gas particle stream has particles which are substantially contained within a region defined by the surface of the gas stream, and upon entering the grind chamber of the mill the first gas particle stream further entrains particles which are present in the chamber to form a second gas particle stream, and wherein the particles entrained in the chamber are located substantially on the surface of said gas stream.

12. A jet mill in accordance with claim 1 wherein the first end of the hollow cylindrical curvilinear body is at a point which is greater than the end of the first hollow cylindrical body so that no particles contact the inner wall of said first hollow cylindrical body.

13. A jet mill in accordance with claim 1 wherein the first end of the hollow cylindrical curvilinear body is at a point which is less than the end of the first hollow cylindrical body so that the gas stream passing through the first hollow cylindrical body contains particles prior to entering the chamber.

14. A jet mill in accordance with claim 13 wherein the particles in the particulate gas stream egressing from the first hollow cylindrical body are substantially concentrated in a peripheral annulus of a primary gas stream and an internal annulus created by a secondary gas stream originating from the gas and particles entrained in and passing through said hollow cylindrical curvilinear body.

15. A jet mill in accordance with claim 1 wherein the ratio of the diameters of the first hollow cylindrical body and the hollow cylindrical curvilinear body is from about 1.0:0.05 to about 1.0:0.95.

16. A jet mill in accordance with claim 1 wherein at least one jetting nozzle is present and wherein the relative throughput efficiency and the grinding efficiency of the mill is improved by from about 5 to about 30 percent.

17. A method of grinding particles comprising:

a) introducing unground particles into a grinding chamber of a fluidized bed jet mill;

b) injecting gas from a plurality of sources of high velocity gas into the grinding chamber through a nozzle or nozzles comprising: a first hollow cylindrical body with a first diameter and a first end, wherein one end of the body is directed towards a center of the jet mill and the other end traverses an outer wall of the jet mill; and a hollow cylindrical curvilinear body with a diameter which is less than said first diameter, wherein the first end of the hollow cylindrical curvilinear body is collinear with a long axis of said first hollow cylindrical body, wherein the first end of the hollow cylindrical curvilinear body is at a point approximately equal to the end of the first hollow cylindrical body, wherein a second end of the curvilinear body passes through an opening in the side wall of said first hollow cylindrical body, and wherein said side wall opening is leak free and resides within the grinding chamber of the fluid bed mill; wherein the nozzle communicates the gas stream from the nozzle to the grinding chamber thereby forming at least two particulate gas streams in the jet mill;

c) forming a fluidized bed of said unground particles within the grinding chamber;

d) entraining and accelerating a portion of said unground particles with said high velocity gas to form a high velocity particle gas stream;

e) fracturing said portion of said entrained particles into smaller particles by projecting the particle gas stream against opposing particle gas streams;

g) separating from said unground particles and said smaller particles a portion of said smaller particles smaller than a selected size;

h) discharging said portion of said smaller particles from said grinding chamber; and i) continuing to grind remaining said smaller particles and said unground particles by reentrainment until said smaller particles, smaller than a selected size, are obtained thereby, wherein said high velocity gas stream has a high surface area periphery or profile, and wherein the relative throughput grinding efficiency is improved from about 1 percent to about 30 percent compared to a mill without said curvilinear body.

18. The method of claim 17 wherein said unground particles are electrostatographic developer material particles with a mean volume diameter of about 5 to about 5,000 microns and said smaller ground particles have a mean volume diameter of about 3 to about 30 microns.

19. The method in accordance with claim 17 further comprising an integral face plate member attached to the end of the first hollow cylindrical body.

20. The method in accordance with claim 17 further comprising fracturing particles by projecting the particle gas stream against at least one stationary target.

21. A method for grinding particles of electrostatographic developer material comprising:

a) introducing unground particles of electrostatographic developer material into a grinding chamber of a fluidized bed jet mill;

b) injecting gas from a plurality of sources of high velocity gas attached to an injecting nozzle comprising: a first hollow cylindrical body with a first diameter and a first end, wherein one end of the body is directed towards a center of the jet mill and the other end traverses an outer wall of the jet mill; and a hollow cylindrical curvilinear body with a diameter which is less than said first diameter, wherein the first end of the hollow cylindrical curvilinear body is collinear with a long axis of said first hollow cylindrical body, wherein the first end of the hollow cylindrical curvilinear body is at a point approximately equal to the end of the first hollow cylindrical body, wherein a second end of the curvilinear body passes through an opening in the side wall of said first hollow cylindrical body, and wherein said side wall opening is leak free and resides within the grinding chamber of the fluid bed mill; wherein the nozzle communicates the gas stream from the nozzle to the grinding chamber thereby forming at least two particulate gas streams in the jet mill;

c) forming a fluidized bed of said unground particles;

d) accelerating a portion of said unground particles with said high velocity gas stream to form a high velocity particle gas stream;

e) fracturing a portion of the accelerated particles into smaller particles by projecting at least two particle streams in partial or complete opposition so that substantially all of the particles accelerated by the gas stream impact particles contained in an opposing stream;

f) entraining and accelerating a portion of said unground particles and smaller partially ground particles into and through said second end of the hollow cylindrical curvilinear body with said high velocity gas to form a second high velocity particle gas stream;

g) separating from said unground particles and said smaller particles a portion of said smaller particles smaller than a selected size;

h) discharging said portion of said smaller particles from said grinding chamber; and i) continuing to grind the remainder of said smaller particles and said unground particles through reentrainment of particles in accordance with step d) and f) until said smaller particles smaller than a selected size are obtained thereby.

22. The method of claim 21 wherein the size of said smaller particles smaller than a selected size have a mean volume diameter of from about 3 to about 30 microns.

23. A jet mill in accordance with claim 1 wherein the particulate material for grinding is selected from the group consisting of toner particles, pigment particles, resin particles, toner surface additive particles, toner charge control additives, uncoated carrier particles, resin coated carrier particles, metal oxide particles, surface treated metal oxide particles, mineral, and mixtures thereof.

24. A jet mill in accordance with claim 1 wherein said second end of the hollow cylindrical curvilinear body is comprised of a plurality of ends.

25. A jet mill in accordance with claim 24 wherein said plurality of ends of said second end of the hollow cylindrical curvilinear body is comprised of from 2 to 10 ends.

* * * * *